US005750918A

United States Patent [19]

Mangolds et al.

[11] Patent Number: 5,750,918

[45] Date of Patent: May 12, 1998

[54] BALLISTICALLY DEPLOYED RESTRAINING NET

[75] Inventors: Arnie Mangolds, Stow; Michael David Farinella, Mansfield; Daniel Rene Deguire, Blackstone; Robert Lee Cardenas, Framingham, all of Mass.

[73] Assignee: Foster-Miller, Inc., Waltham, Mass.

[21] Appl. No.: 544,012

[22] Filed: Oct. 17, 1995

[51] Int. Cl.[6] ..... F42B 12/00

[52] U.S. Cl. ..... 102/502; 102/213; 102/216; 102/439; 102/504; 102/513; 102/293; 89/1.11; 361/232

[58] Field of Search ..... 102/213, 216, 102/357, 393, 405, 430, 439, 489, 502, 504, 513, 501, 517, 293; 89/1.11, 6.5; 244/3.12; 361/230, 233, 235

[56] References Cited

U.S. PATENT DOCUMENTS

| | | | |
|---|---|---|---|
| H1369 | 11/1994 | Allen, Jr. et al. | 102/213 |
| 1,198,035 | 9/1916 | Huntington . | |
| 1,276,689 | 8/1918 | Poudrier . | |
| 2,251,918 | 8/1941 | Dawson . | |
| 2,296,980 | 9/1942 | Carmichael | 102/489 |
| 2,372,383 | 3/1945 | Lee | 102/504 |
| 2,373,363 | 4/1945 | Wellcome . | |
| 2,856,853 | 10/1958 | McGinnis | 102/216 |
| 3,382,803 | 5/1968 | Swallow et al. . | |
| 3,724,385 | 4/1973 | Beatty et al. . | |
| 3,844,217 | 10/1974 | Ziemba | 102/2 |
| 4,013,919 | 3/1977 | Corbley . | |
| 4,019,306 | 4/1977 | Evans . | |
| 4,039,893 | 8/1977 | Corbley . | |
| 4,089,149 | 5/1978 | Evans . | |
| 4,128,061 | 12/1978 | Kaiser . | |
| 4,145,971 | 3/1979 | Graham et al. . | |
| 4,160,414 | 7/1979 | Stockman et al. . | |
| 4,221,524 | 9/1980 | Morris . | |
| 4,253,132 | 2/1981 | Cover . | |
| 4,307,666 | 12/1981 | Baran . | |
| 4,361,782 | 11/1982 | Reiling . | |
| 4,389,409 | 6/1983 | Miller . | |
| 4,440,086 | 4/1984 | Brotherton et al. . | |
| 4,483,080 | 11/1984 | Knoll . | |
| 4,498,392 | 2/1985 | Billard et al. . | |
| 4,559,737 | 12/1985 | Washington . | |
| 4,676,165 | 6/1987 | Gordon et al. . | |
| 4,716,830 | 1/1988 | Davis et al. . | |
| 4,768,417 | 9/1988 | Wright . | |
| 4,837,217 | 6/1989 | Ogura et al. . | |
| 4,839,980 | 6/1989 | Hersom . | |
| 4,854,240 | 8/1989 | Hirsch et al. . | |
| 4,866,296 | 9/1989 | Thomas . | |
| 4,912,869 | 4/1990 | Govett . | |
| 4,930,918 | 6/1990 | Steppe et al. . | |
| 4,953,475 | 9/1990 | Munach et al. . | |
| 4,959,514 | 9/1990 | Robarge et al. . | |
| 5,009,165 | 4/1991 | Morris | 102/513 |
| 5,093,602 | 3/1992 | Kelly . | |
| 5,113,335 | 5/1992 | Smith . | |
| 5,131,328 | 7/1992 | Chan . | |
| 5,147,338 | 9/1992 | Lang et al. . | |

(List continued on next page.)

FOREIGN PATENT DOCUMENTS

| | | | |
|---|---|---|---|
| 859282 | 12/1940 | France | 102/504 |
| 3146166 | 5/1983 | Germany | 102/504 |

OTHER PUBLICATIONS

Evancoe, U.S. military–researched technologies hold promise of safely fuelling crime and civil disturbances National Defence, May/Jun. 1994, pp. 28–30.

*Primary Examiner*—Harold J. Tudor
*Attorney, Agent, or Firm*—Iandiorio & Teska

[57] ABSTRACT

A ballistically deployed restraining net system including a projectile, a net packaged in the projectile, a net deployment device for unfurling the net in flight, and a fuze for triggering the net deployment device upon the occurrence of a preestablished criteria such as the impact of the projectile with an object, the expiration of a preestablished time period after launch or upon the projectile reaching a predetermined distance to an object.

24 Claims, 11 Drawing Sheets

U.S. PATENT DOCUMENTS 5,148,139 9/1992 Dingle et al. .
5,177,320 1/1993 Reynolds .
5,196,471 3/1993 Rangaswamy et al. .
5,201,666 4/1993 Markham .
5,225,962 7/1993 Neill et al. .
5,245,691 9/1993 Wu .
5,247,419 9/1993 Grundmann .
5,249,527 10/1993 Schwind .
5,251,120 10/1993 Smith .
5,272,981 12/1993 Badura et al. .
5,322,982 6/1994 Leger et al. .
5,326,101 7/1994 Fay .
5,329,854 7/1994 Komstadius ..... 102/505
5,343,795 9/1994 Ziemba et al. ..... 89/6.5
5,345,164 9/1994 Lesea .
5,351,623 10/1994 Kissel et al. .

BALLISTICALLY DEPLOYED RESTRAINING NET

FIELD OF INVENTION

This invention relates to a ballistically deployed restraining net system in which a restraining net is packaged in a projectile and unfurled in flight proximate the target to be restrained.

BACKGROUND OF INVENTION

There are a number of less than lethal weapons currently used by law enforcement and military personnel including tear and pepper gas sprays and bombs. These types of weapons, however, are not always effective especially when the perpetrator(s) or enemy personnel are armed. These types of weapons also fail to restrain the target. Some prior restraining net systems have been developed (see, e.g., U.S. Pat. No. 4,912,869), but they require either specialized launching guns, have very short ranges, and/or are susceptible to entanglement on obstructions in the path between the launching gun and the target.

Law enforcement and military personnel are not usually receptive to restraining net systems which require specialized launching guns. Such systems are also cost prohibited since the design and production costs of the launching gun are excessive. Also, restraining net systems wherein the net is deployed in its open state or wherein the net is unfurled shortly after launch do not have much of a range because of the drag of the net in flight. Moreover, it is difficult to aim these types of weapons. Such systems are also easy to elude. Worse, the net in its open unfurled state can become entangled on obstructions (e.g. tree branches) in the path between the net launcher and the perpetrator. Finally, prior restraining net systems are ineffective at restraining hostile and/or armed individuals.

SUMMARY OF INVENTION I

It is therefore an object of this invention to provide a ballistically deployed restraining net system.

It is a further object of this invention to provide such a system which can be used in conjunction with standard issue weapons.

It is a further object of this invention to provide such a system which has a very long range.

It is a further object of this invention to provide such a system which has a variable range.

It is a further object of this invention to provide such a system in which the net avoids entanglement on objects in the path between the launcher weapon and the target.

It is a further object of this invention to provide such a system which is effective at restraining hostile and/or armed individuals.

It is a further object of this invention to provide such a system which can be designed to temporarily incapacitate as well as restrain a hostile individual.

It is a further object of this invention to provide an effective method for ballistically deploying a restraining net.

This invention results from the realization that the problem of net entanglement and the limited range associated with prior net launching systems which cast the net out in the unfurled position can be overcome by a design in which the restraining net is packaged in a projectile during flight and then deployed only in the proximity of the target and from the further realization that the projectile can be designed to be compatible with existing firearms so that specialized launching guns are not required.

The projectile, designed to be fired from a standard firearm, can be a one piece design or a two piece design in which the net and net deployment system are packaged in one part and a fuze is housed in the second part. The weights on the perimeter of the net can even be made an integral part of the projectile net housing. The fuze can be designed to trigger the net deployment system upon impact with a target, after a predetermined time from launch, and/or upon reaching a predetermined distance from the projectile to the target. The net can be designed with an integral electrical circuit or an irritating chemical substance for disabling a perpetrator, or a glue to extend the capture time and/or a marking chemical used to later clearly identify a suspect. A number of innovative techniques can be used to package the net in the projectile and there are a variety of novel net designs available to optimize net deployment and retention of the target.

This invention features and, depending on the specific implementation, may comprise, include, or consist essentially of a ballistically deployed restraining net system. There is a projectile with a net packaged therein and a net deployment device for unfurling the net in flight. Further included are means for triggering the net deployment device upon the occurrence of a preestablished criteria. The means for triggering is typically a fuze and in one embodiment the preestablished criteria is the impact of the projectile with an object. In this case the fuze includes an impact detector having a weight housed in a mechanical switch, the weight is slidable within the switch and closes the switch upon impact. In another embodiment, the fuze includes a timer and the criteria is the expiration of a preestablished time period. The timer may be programmable and the system may further include a range detector mounted on the launching gun, the range detector automatically programming the fuze to trigger after predetermined time which is function of the range to an object and the rate of the flight of the projectile to the object. In another embodiment a fuze is an infrared proximity detector and the fuze is triggered after the projectile reaches a predetermined distance to the object.

In one embodiment, the projectile includes two portions: a net projectile portion and a fuze projectile portion. The net and the deployment device are housed in the net projectile portion and the fuze is housed in the fuze projectile portion. Further included are means for separating the two projectile portions in flight such as a gas chamber in the net projectile portion in communication in one end thereof with the fuze projectile portion. There are means for pressurizing the gas chamber with a gas such as a passage connecting the propellant chamber of the projectile with the gas chamber to charge the gas chamber with propellant gas when the projectile is launched. The embodiment with two projectile portions further includes a tether extending in between the fuze projectile portion and the net projectile portion for maintaining both the projectile portions in the same flight path. The net projectile portion preferably includes a nose cone and the tether is wrapped about the nose cone. To prevent snap back of the tether upon separation of the fuze projectile portion from the net projectile portion, one half of a triangular shaped hook and loop strip is affixed to the nose cone, the other half is attached to the tether.

In another embodiment, the projectile remains as single unitary body during flight and includes a net chamber divided into weight portions connected to the net. A small charge is placed in the base of the net chamber to separate the weight portions in flight upon triggering of the fuze.

This invention further features a novel technique for tightly packaging a restraining net within a projectile for optimum deployment proximate a target. In one embodiment, the net is packaged in the net chamber with an apex of the net about a longitudinal member and the folds of the net are placed above and below the longitudinal member. In another embodiment, the net is packaged after it is folded to form a plurality of tendrils extending outward from the apex of the net.

This invention also features an open electrical circuit integral with the net for shocking an armed or dangerous perpetrator at the same time he is captured by the net. There is a power source and an open electrical circuit connected to the power source for disabling a target captured in the net. The net may also be manufactured to include a disabling adhesive, a disabling chemical, or a marking substance to clearly mark a perpetrator who has been captured by the net.

This invention also features a method of deploying a restraining net, the method comprising launching a projectile having a restraining net and weights packaged therein, establishing a criteria for deploying the net, and deploying the net in flight upon the occurrence the established criteria. The criteria may be the impact of the projectile of the projectile with an object, the expiration of a preestablish time, or upon the projectile reaching a predetermined distance to an object. The method further includes separating a fuze portion of the projectile from the net portion of the projectile in flight after launch if the projectile of a two piece design or alternatively triggering an explosive to separate the net weights if the projectile is a one piece design.

If the projectile is of a two piece design, the method further includes maintaining both projectile portions in the same flight path by tethering the net portion to the fuze portion. Separating may include charging a gas chamber in communication with the fuze projectile portion with a gas during launch. It is essential that the net not only be packaged tightly so that it fits in the projectile which can be fired from existing firearms, but also that the net be packaged so that when it is deployed it unfurls to optimize capture of a hostile individual. In one technique, the net is packaged by forming a plurality of tendrils extending from an apex of the net in the apex of the net is placed first within the projectile. In another embodiment, the net is packaged by placing the apex of the net about a longitudinal member within the projectile and making folds of the net above and below the longitudinal member.

Finally, the method of this invention further includes disabling a target captured in the net by shocking the target, subjecting the target to an irritating chemical substance, or subjecting the target a disabling adhesive within the net. The method may also feature marking a target captured in the net by coating the net with a marking substance.

DISCLOSURE OF PREFERRED EMBODIMENT

Other objects, features and advantages will occur to those skilled in the art from the following description of a preferred embodiment and the accompanying drawings, in which.

Figures 1A, 1B, 1C:
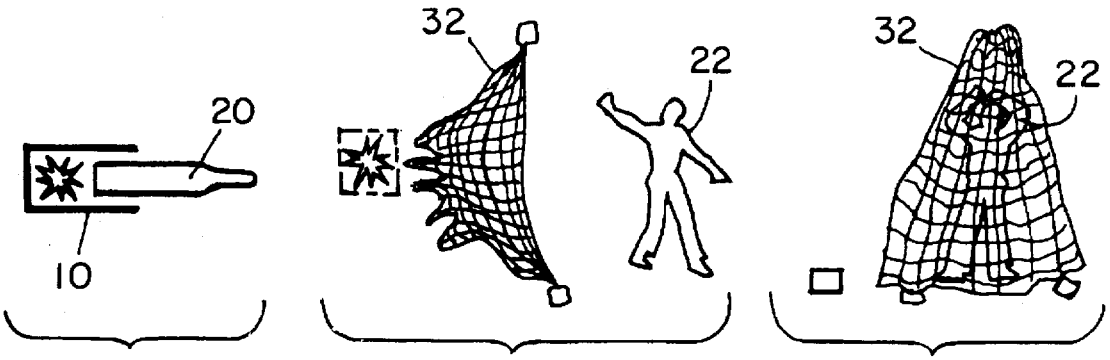
FIGS. 1A–1C are schematic views showing the operation of the ballistically deployed restraining net system of this invention.

The ballistically deployed restraining net system of this invention is designed such that a restraining net is packaged in projectile 20, FIG. 1A which is launched from launcher 10, such as a standard issue 37 mm or 40 mm handfired weapon with a range of over 100 feet. After the occurrence of a preestablished criteria, as shown in FIG. 1B, such as the impact of projectile 20 with target 22, or after a preestablished time after launch, or when projectile 20 is within a predetermined range of target 22, restraining net 32 is deployed and unfurled to its full 18 foot diameter to capture and restrain target 32, FIG. 1C. Target 22 is entangled and may be further disabled by a non-lethal sting circuit which is integrated into net 32. Alternatively, net 32 may include a disabling chemical substance, a marking compound, and/or an adhesive.

In contrast to prior systems, the ballistically deployed restraining net system of this invention can be used in conjunction with standard issue weapons, has a very long range, does not become entangled on objects in the path between the launcher weapon 10 and the target 22, and is effective at a restraining hostile and/or armed individuals since it can be designed to temporarily incapacitate as well as restrain a hostile individual.

Figure 2:
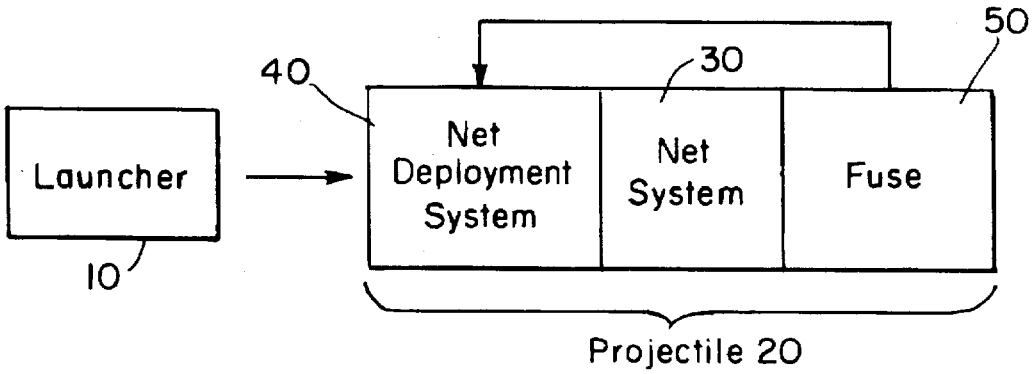
FIG. 2 is a block diagram of the major components of the ballistically deployed restraining net system of this invention.

Projectile 20, FIG. 2 includes 3 primary components: tightly packaged net 30, net deployment system 40 for unfurling the net in flight, and fuze 50 for triggering net deployment system 40 upon the occurrence of a preestablished criteria. Each component is discussed in turn.

Figure 3:
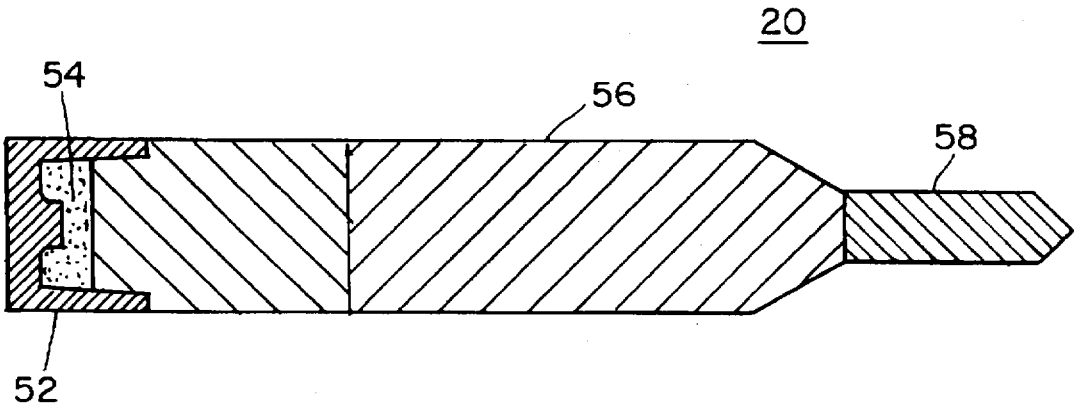
FIG. 3 is a schematic view of the projectile of the ballistically deployed restraining net system of this invention.

Projectile 20, FIG. 3, includes propellent casing 52 configured to be fired from weapon such as a PI-M20340 mm grenade launcher and other caliber weapons. The load size of propellent 54 within casing 52 is matched with the weight and desired muzzle velocity of projectile 20. The net, the weights associated with the perimeter of net, and the deployment subsystem are packaged in portion 56 and a fuze for triggering the deployment of a net is housed in section 58. The fuze can be an impact detector, a proximity detector, can include a timer to trigger deployment of the net upon the expiration of a preestablished time, or may be an infrared proximity detector as discussed below.

Projectile Designs

Figure 4:
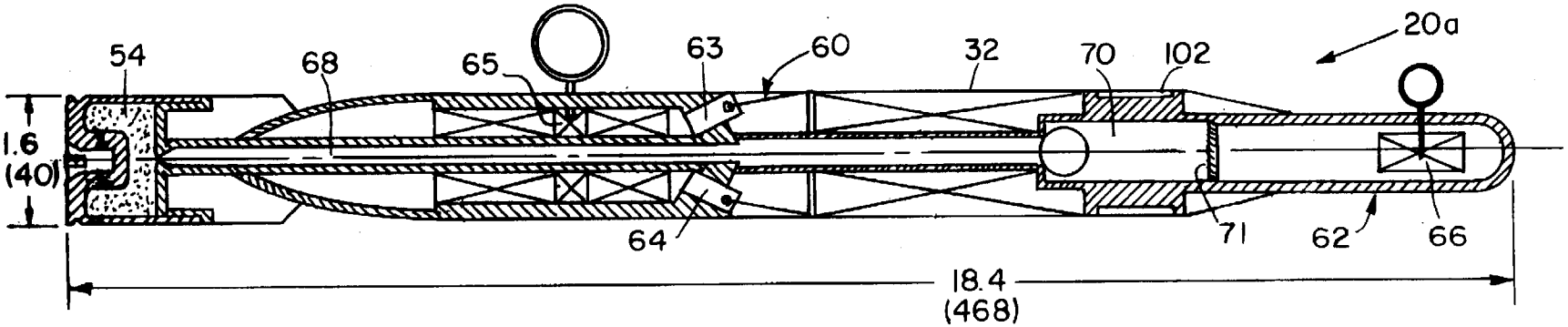
FIG. 4 is a more detailed schematic view of a projectile having a fuze portion and a net portion in accordance with one embodiment of the ballistically deployed restraining net system of this invention.
Figure 6D:
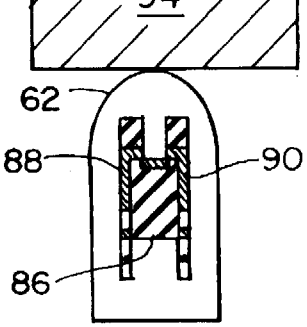
FIGS. 6A–6D are schematic views of an impact activated mechanical fuze in accordance with this invention.
Figure 6C:
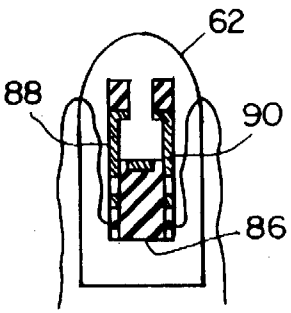
Figure 6B:
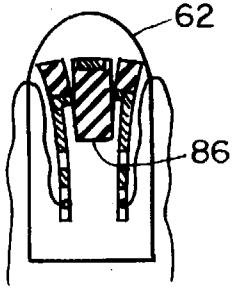
Figure 6A:
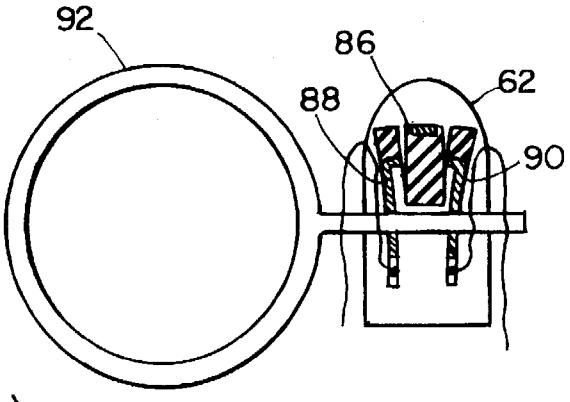

In one embodiment, projectile 20*a*, FIG. 4 is a two piece construction wherein fuze projectile portion 62 is separable from net projectile portion 60. Net projectile portion 60 houses restraining net 32 which, in this embodiment, is an 18 foot by 12 inch size mesh net with 8 perimeter weights, e.g., 63, 64 housed with the net and deployed by net deployment device 65. Fuze projectile portion 62 includes fuze switch 66 for triggering net deployment device 65, explained in more detail with respect to FIGS. 5 and 6.

In operation, both portions 60 and 62 leave the launcher at the same time but immediately after leaving the muzzle, fuze projectile portion 62 separates from net projectile portion 60. Gas from the launch propellant 54 travels down passage 68 to gas chamber 70 charging gas chamber 70 to a pressure of 65 psig. One wall 71 of gas chamber 70 is common with the exterior of fuze projectile portion 62. Upon clearing the launcher barrel, the driving force on the combined projectile suddenly stops and the expanding gas in chamber 70 pushes wall 71 of fuze projectile 62 ahead of net projectile portion 60 at an increased velocity of 40 feet per second. As the two projectiles separate, fuze projectile portion 62 pulls a tethered line (discussed below) from the net projectile, thus losing mass and decelerating. At 6 feet, the tether is fully deployed and absorbs the shock of the two projectiles with little rebound. The tether causes the two projectile portions to track at a common velocity and, since the ballistic densities of the two projectiles are matched, they follow the same trajectory.

As discussed above, fuze switch 66, FIG. 5 triggers net deployment circuit 65 upon impact of fuze projectile portion 62 with an object. When fuze switch 66 is closed, it completes the circuit along fuze leads 74 and 76 incorporated into the tether. Lithium battery 78 connected to thyristor type latch 80 is used to trigger pyrotechnic cartridge 82 for a typical fire time at 4 amps of three milliseconds. Trigger circuit 65 is armed by removing pin 84. When the fuze switch 66 is closed on impact with a target, latch 80 activates pyrotechnic pressure cartridge 82 which detonates after 3–10 milliseconds deploying the net.

Fuze switch 66 is shown in more detail in FIGS. 6A–6D. The nose of fuze projectile portion 62, FIG. 6A includes switch weight 86 and two electrical spring contacts 88 and 90. Fuze 66 is armed by removing pin 92, FIG. 6A. The acceleration of the projectile out of the muzzle of the launcher displaces weights 86 from the position shown in FIG. 6B to the position shown in FIG. 6C until projectile portion 62 impacts object 94, FIG. 6D, which drives weight 86 forward to interconnect electrical contacts 88 and 90 as shown.

Figure 5:
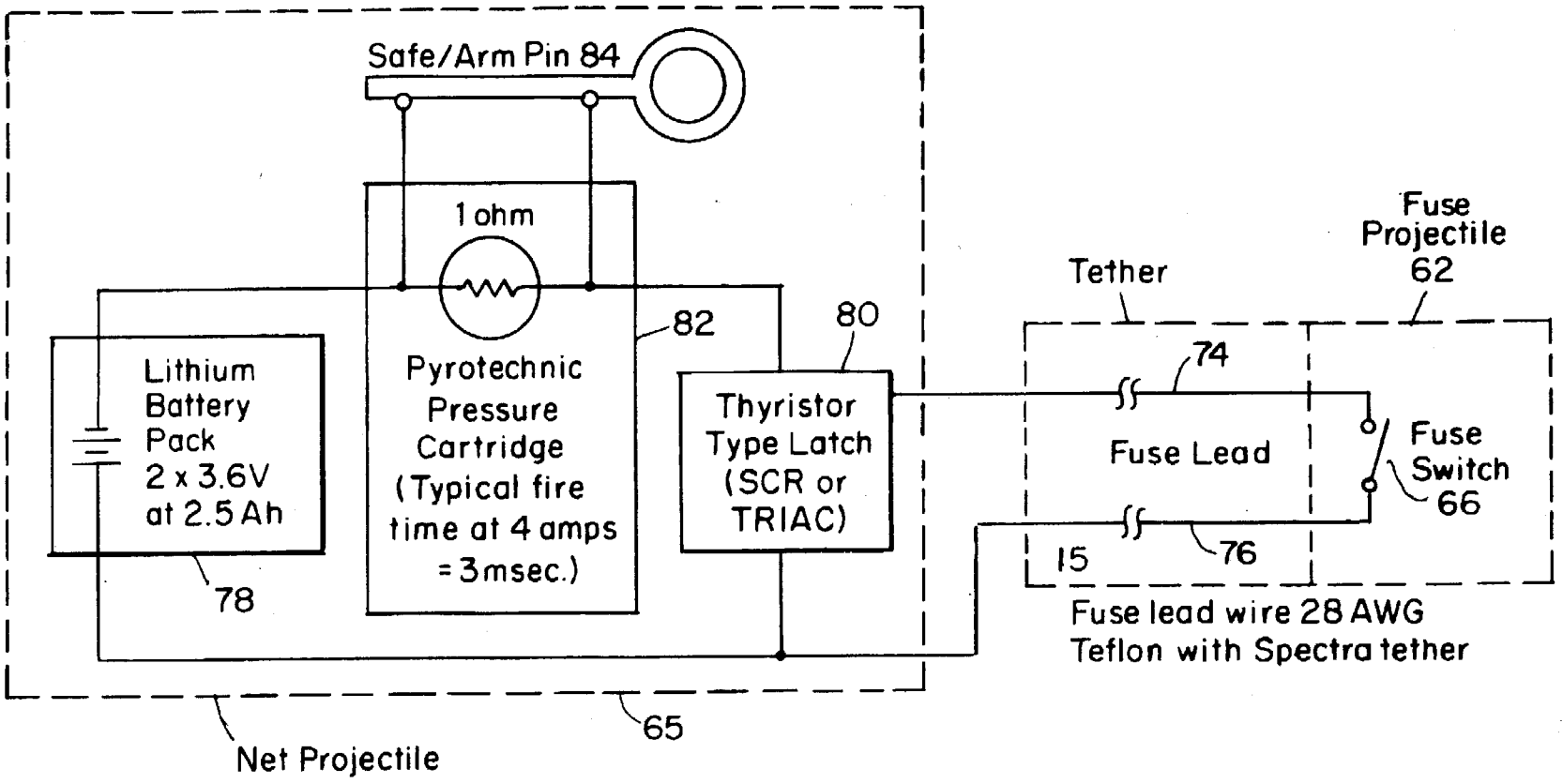
FIG. 5 is a circuit diagram of the fuze and a net deployment device for unfurling the restraining net in flight in accordance with this invention.
Figure 7A:
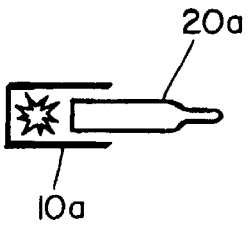
FIG. 7A–7E are schematic views of the method for ballistically deploying a restraining net in accordance with this invention.
Figure 7B:
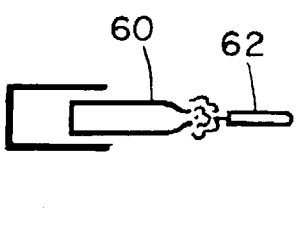
Figure 7C:
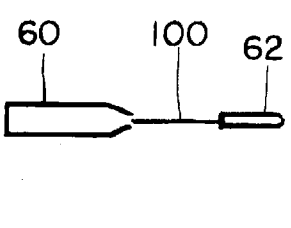
Figure 7D:
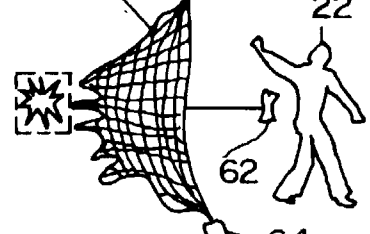
Figure 7E:
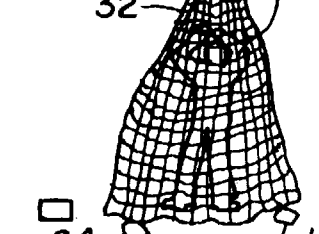

In the embodiments shown with respect to FIGS. 4–6, two piece projectile 28, FIG. 7A is launched from launcher 10*a* and after launch, the velocity of portion 62 is increased, FIG. 7B,with respect to the velocity of portion 60 by means of pressurized gas chamber 70, FIG. 4. Six foot tether 100, FIG. 7C maintains portions 60 and 62 in the same flight trajectory. Upon impact of fuze portion 62 with target 22, FIG. 7D, weight 86 connects contacts 88 and 90, FIG. 6D closing circuit 65, FIG. 5, which deploys net 32. The heavier mass of weights 63 and 64 unfurl net 32 to capture the target as shown in FIG. 7E.

Figure 8B:
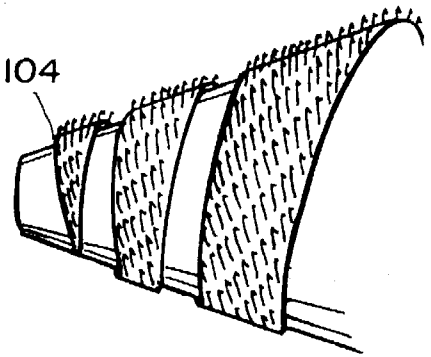
FIGS. 8A–8B are schematic views of the tethered deployment platform for the two piece projectile shown in FIG. 4 in accordance with this invention.
Figure 8A:
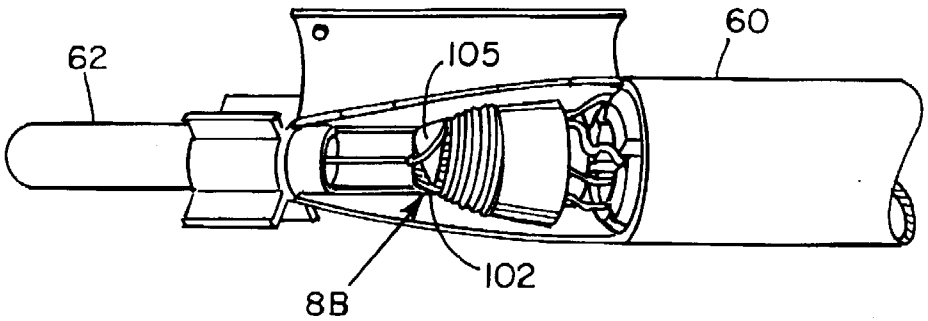

Tether 100, FIG. 8A, is the mechanical and electrical link between fuze projectile portion 62 and net projectile portion 60. Tether 100 is stored on nose cone 102 of net projectile portion 60 and is pulled away from its stored position by the fuze projectile portion 62 during the separation period, FIGS. 7B–7C. Tether 100 is preferably a 100 pound test "Spectra" cord typically used for high performance sports kites. It has a 0.018" diameter and a weight per 100 ft. of 0.024 lbs. Tether 100 is held in place on nose cone 102 by a spray adhesive. In order to prevent rebound during separation of fuze projectile portion 62 with respect to net projectile portion 60, the hook half of triangular shaped hook and loop strip 104, FIG. 8B, is attached to nose cone 102 and the loop half of a similarly shaped hook and loop strip 105, FIG. 8A, is attached to tether 100. By tailoring the shape of the mating hook and loop strips, the damping force can be fine tuned so that the deployment energy is completely dissipated at the end of the tether 100 upon separation of fuze projectile portion 62 from net projectile portion 60 in flight. The triangular shaped strip of hook and loop material is positioned to increase peel resistance. In testing separation velocities of 40 to 60 feet per second were achieved with no elastic rebound back.

Figure 9A:
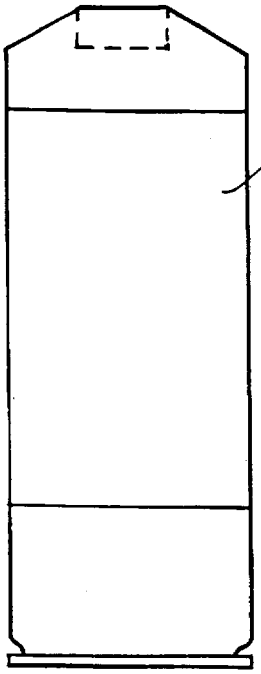
FIGS. 9A–9E are schematic views of a one piece projectile for the ballistically deployed restraining net system of this invention.
Figure 9B:
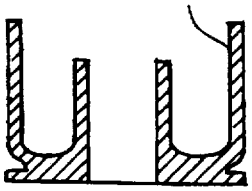
Figure 9C:
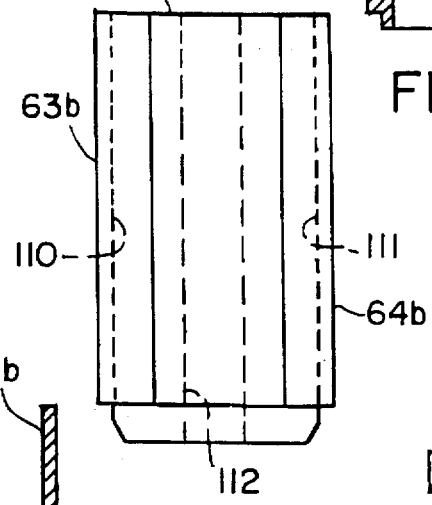
Figure 9D:
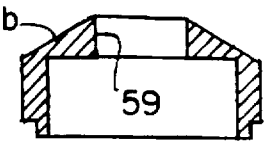

In an alternative embodiment, cartridge 20*b*, FIG. 9A, includes propellant casing 52B, FIG. 9B, net casing 56*b*, FIG. 9C, and fuze housing 58*b*, FIG. 9D. The various types of fuzes housed in fuze housing 58*b* are discussed infra. Cartridge 20*b* is made of a rigid plastic material such as "delvia" is typically 37 mm in diameter and 4.75" tall. Net casing 56*b* includes integral weights 63*b*, 64*b*, etc., formed by scribe lines 110 and 111 equally spaced longitudinally about the perimeter of casing 56*b* as shown. A small charge, placed in cavity 112, is triggered by the fuze in housing 58*b* to separate weight portions 63*b* and 64*b* in flight. The perimeter of the net housed in casing 56*b* is connected to the weights so that the weights, once separated in flight, unfurl the net for capture of a suspect.

Fuze Designs

In addition to the fuze design depicted with respect to FIGS. 5–6, the fuze housed in fuze housing 58*b*, FIG. 9D, may include a proximity detector or a manually or automatically set time delay fuze. Each device is discussed in turn.

Figure 10:
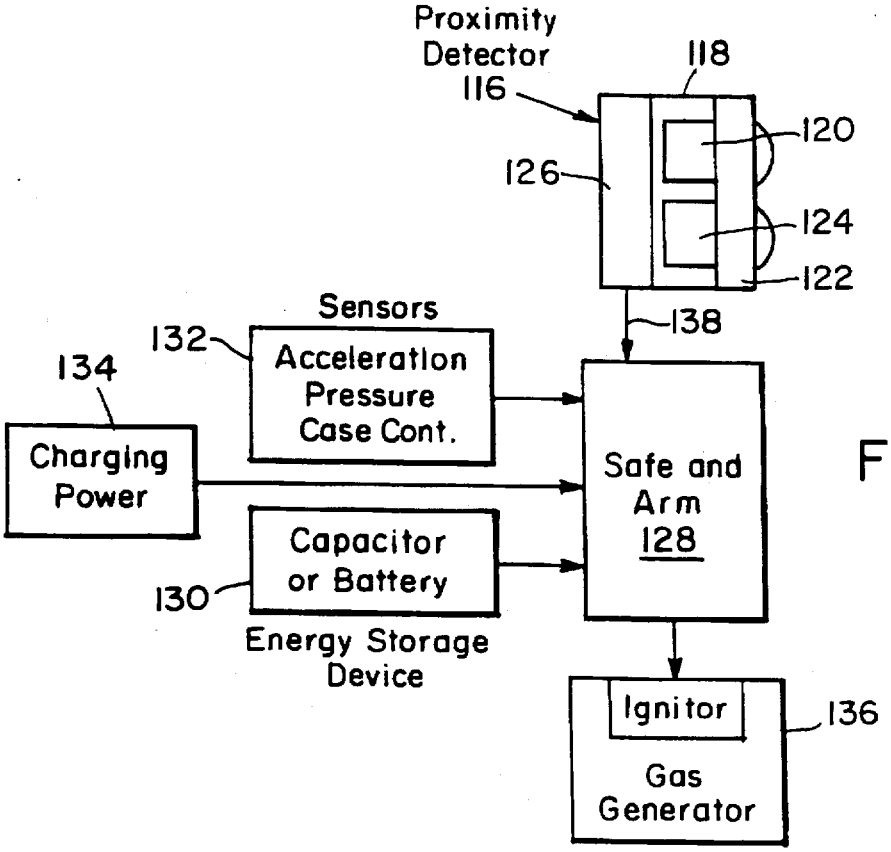
FIG. 10 is a block diagram of the infrared proximity detection subsystem for the one piece projectile shown in FIG. 9.

Proximity detector 116, FIG. 10, includes a sensor 118. Sensor 118 includes transmitter 120, lens 122, and receiver 124. Sensor 118 is connected via electronics package 126 to safe and arm circuit 128. Sensor 132 may be an accelerometer to detect firing acceleration levels (Gs) or a pressure sensor to detect a launch pressure wave magnitudes. After firing, sensor 132 provides confirmation of firing to safe and arm circuit 128.

Safe and arm circuit 128 requires the following criteria to be met: power source 130 must be activated; the acceleration, and/or pressure from sensor 132 must be sufficient to indicate firing; and a command to fire has been issued by proximity sensor 116 before safe and arm circuit 128 ignites gas generator 136.

Power device 130 is a small lithium battery with a self life of about 10 years mounted in the projectile nose cone. A self test could be performed prior to use to determine if adequate battery life is still present. An access cover in the nose cone allows replacement of the battery should the shelf life of the battery be exceeded. Alternatively a capacitor can be incorporated in the projectile as an energy storage device to store power required to function the fuze during deployment. Energy for the capacitor will come from a battery pack in the launcher gun which charges the capacitor at launch. This embodiment requires commutation pins in the breach of the launcher gun to pass power from the launcher to the projectile.

A red or infrared pulse modulated reflective beam is transmitted by led or laser 120 through lens 122. Receiver 124, FIG. 10 detects the beam after it is reflected off a potential target and electronic circuit 126 delivers a voltage on line 138 which varies with respect to the distance from the transmitter (and hence the projectile) to the target. When a predetermined distance to the target is reached, safe and arm circuit 128 triggers the firing of a charge in cavity 112 of net housing **56*b*, FIG. 9C, separating the weights 63*a* and 64*b* along the scribe lines 110 and 111** to unfurl the net.

Figure 11:
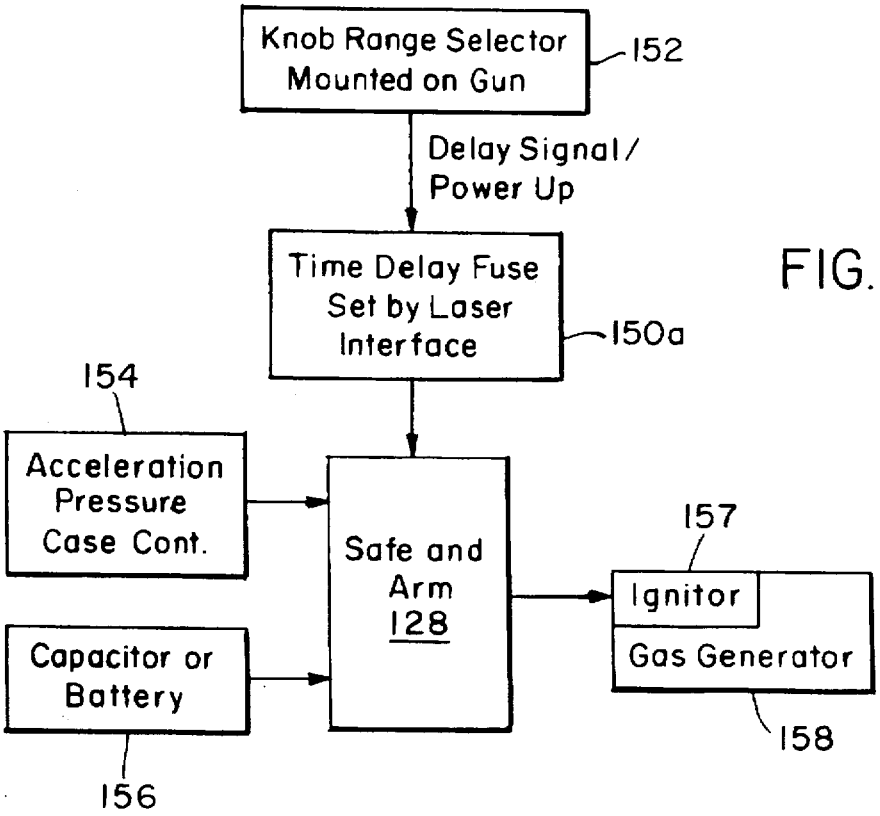
FIG. 11 is a block diagram of a manually set timer circuit of another embodiment of the fuze of the one piece projectile shown in FIG. 9.

In another embodiment, timer circuit **150*a* FIG. 11, is set manually by a range selector 152 on the launching gun based on a best guess of the distance to a given target and the expected flight time. After the set predetermined time from launch, timer 150*a* triggers safe and arm circuit 128 to ignite the charge to deploy the net. Timer 150*a* is a settable count down timer. The timer value is set when the trigger of the launcher is pulled. The value of the range selected is saved in the timer as either an analog or digital value depending on the range and accuracy of the fuze required by the projectile. When safe and arm circuit 128 detects the projectile has been fired, the count down begins counting. After the time delay has passed the command to fire, a signal is sen to safe arm circuit 128 to ignite the gas generator and unfurl the net. The reminder of the components in this design are similar to proximity detector 116, FIG. 10**.

Figure 12:
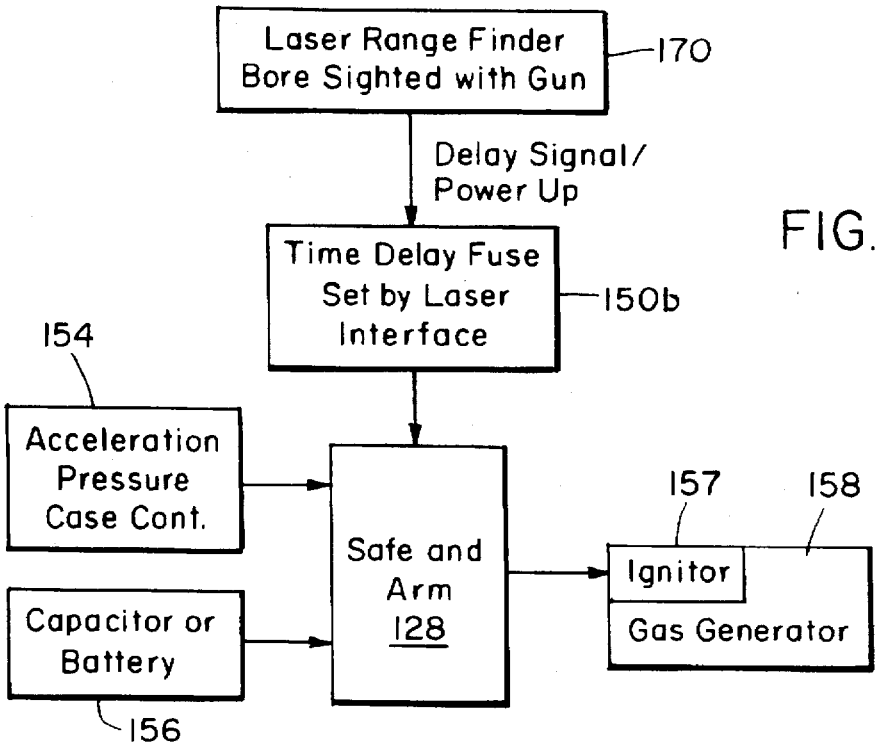
FIG. 12 is a block diagram of the automatically set timer circuit of another embodiment the fuze of the one piece projectile shown in FIG. 9.

In still another embodiment, the launching gun is equipped with laser range finder 170, FIG. 12, which automatically programs timer circuit **150*b*** based on the detected range from the gun to the target and the expected flight time.

Net Designs

The net housed in net housing, FIG. 9C, must be strong and large enough to restrain a hostile perpetrator and yet small enough to fit within a medium caliber such as a 40 mm projectile. The net must be able to deploy efficiently from a fully packed net to a fully open net. After the fuze in fuze housing **68*b*, FIG. 9C triggers the charge in cavity 112 of net housing 56*b*, FIG. 9C, the discrete weights, attached to a special perimeter line sized to be stressed independent of the net, causes the net to unfurl. The perimeter weights pull the net to its full open position. During this operation, the net is suddenly subject to several dynamic forces. It is jerked open from a highly compressed state, and immediately subjected to tensile forces from the pull of the weights and the aerodynamic drag forces. As the weights pull the net to its full diameter, any residual energy in the weights could cause the net to stretch and the elastically rebound. At this point, all the supporting system hardware such as the fuze housing 58*b*, FIG. 9D, and propellant casing 52*b*, FIG. 9B become residual hardware which must be safely disposed. When the net has achieved its full open position, FIG. 1B**, it is in the free, open flight regime. During this operational regime, the net is subjected to aerodynamic drag forces and its ballistic properties are the prime consideration. Drag forces have been calculated and designed to slow the flight speed and to collapse the net. These adverse actions are further limited by timing the net opening so that at the full open position the net is proximate the target.

The capture sequence, FIG. 1C, is the final operational regime. From a free flight position, the net will impact the perpetrator causing that portion of the net to stop and serve as the pivot point about which the rest of the net wraps. The momentum of the perimeter weights carries the net around the individual thus wrapping him in the capture net. The wrapping action of the net causes the weights to impact other sections of the net and become entangled in those sections. The weights are designed to enhance wrap-up. This entanglement action makes it difficult for the captured individual to pull the net free. In addition to the weights, the net's mesh size also aids in restraining the individual. The mesh size is designed to limit mobility and function by preventing free and full use of the arms, inhibiting running action by limiting the stride length and forcing a stooped posture. All of this serves to trip, tie up and confuse the captured individual. The line strength prevents the individual from simply ripping through the net and the small line diameter makes it painful to break the net by pulling on individual meshes. As the individual becomes more entangled, the more difficult it becomes for him to simply pull the net free. The captured person then has to take time to try and sort his way out of the net thus delaying his escape and severely limiting his ability to fight. The net also provides the law enforcement agent with a simple means of controlling the perpetuator for final arrest.

Figure 13:
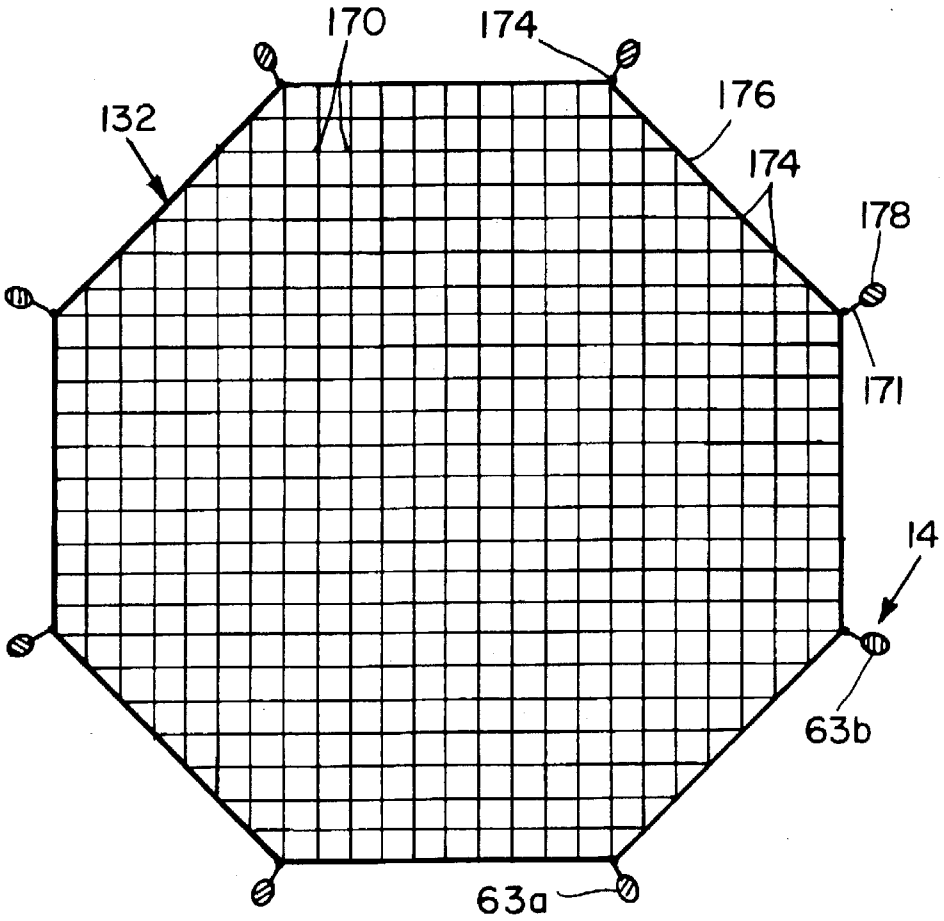
FIG. 13 is a schematic view of the preferred embodiment of the restraining net used in the ballistically deployed restraining net system of this invention.

A square mesh net design is illustrated in FIG. 13. Although only a square mesh is illustrated, other mesh shapes are possible and add different characteristics to the net. These shapes include a spiral mesh design, a herringbone mesh design and a multiple mesh density design. Net 32 is fabricated from a lightweight, high strength twine or braided cord of nylon, Spectra or Kevlar. The Spectra and Kevlar materials have the advantage of high strength to weight, and low weight to volume ratios thus allowing a relatively large net with adequate line strength to be packaged into munitions for hand held launchers such as 37 mm and 40 mm caliber weapons. Cord breaking strengths on the order of 50 to 100 lbs are used for the personal capture nets. Net diameter and mesh size can be optimized of different munitions. Personal capture nets range in diameter from 10 feet to 12 feet with a mesh size ranging from 3 inches to 8 inches.

Figure 14:
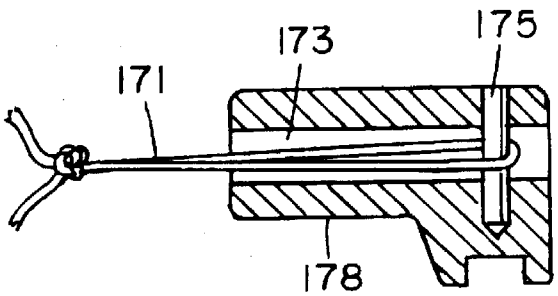
FIG. 14 is a schematic view of the weight perimeter line attachment assembly for the net shown in FIG. 13.

The nets are a knotted construction with a knot at each node 170 or line intersection. The net knots are single knot square mesh netting knots, the perimeter line knots 172 are single overhand knots and the pull point knots 174 are "double overhand" knots. Some materials, such as Spectra, may require a double knot at each node. The perimeter of the net is reinforced with a perimeter line 176 which features leader loops 171 which are attached to the perimeter weights. This attachment can be made in several ways. Loop 171, FIG. 14 is captured within cavity 173, in weight 178 and held in place by pin 175. The weight could also be potted or cast onto the leader loop.

Figure 9E:
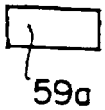

The weights can be fabricated from any material which will provide the mass to fully deploy the net, provide forward momentum for sustained flight and enough momentum to swing the net around the target and become entangled. When assembled, the weights form net housing **56*b*, FIG. 9C which also houses the net deployment pyrotechnic charge in chamber 112 which separates the weights when triggered by the fuze in 59*a*, FIG. 9E, in cavity 59 of fuze housing 58*b*, FIG. 9**D. The multi-function design of the weights reduces the residual materials which could harm a potential target.

Sting Net Designs

As discussed supra, the net can be incorporated with one or more "sting" circuits to shock and disable a perpetrator.

Figure 15:
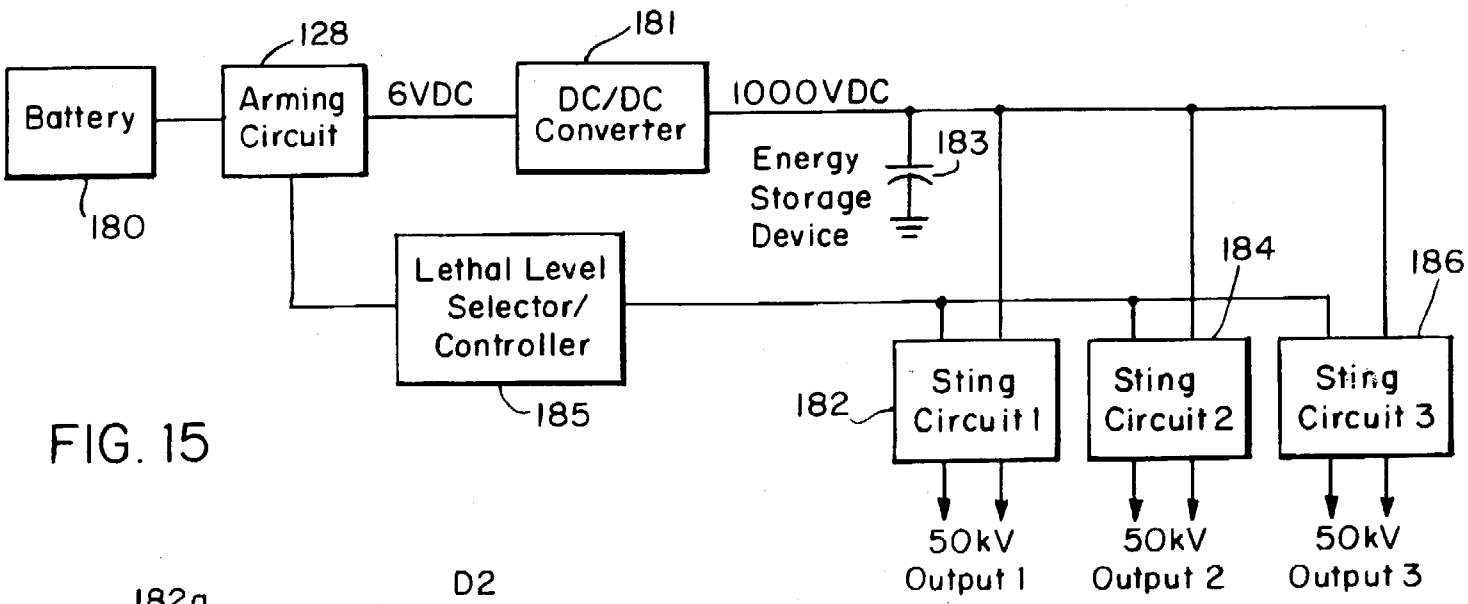
FIG. 15 is a block diagram of the sting net components in accordance with this invention.

A power source 180, FIG. 15, such as a 6-volt battery, supplies current to sting circuits 182, 184, and 186 to provide open 50 kv electrical circuits integral within net 32, FIG. 13. DC/DC voltage converter generator 181 with a step-up transformer and full wave bridge rectifier converts the battery voltage and charges energy storage capacitor 184 to an intermediate voltage of 500 to 1000V. Microcontroller 186 provides the ability to sequentially activate several electronic switches to channel the energy in storage capacitor 184 through a step-up transformer to wiring in the net. Several independent output circuits 182, 184, 186 each driven by one of the electric switches provide redundancy in case one or more of the circuits in the net is shorted or broken.

Arming circuit 128, FIG. 10 activates the sting circuit only after the net has been unfurled. Primary power is provided to first stage dc/dc converter 181 that produces an intermediate voltage of about 1000 VDC and powers the individual sting circuits 182, 184, and 186. Power is also sent to the lethality level selector and controller 186. Circuit 186 controls the pulse rate and voltage level of the individual sting circuits. Capacitor 184 maintains energy storage in the intermediate voltage supply system. Sting circuits 182, 184, and 186 step the final voltage level up to 2 kV to 100 kV, depending on the level selected. Should one of the HVP outputs become shorted, the other circuits will continue to operate independently.

Figure 16:
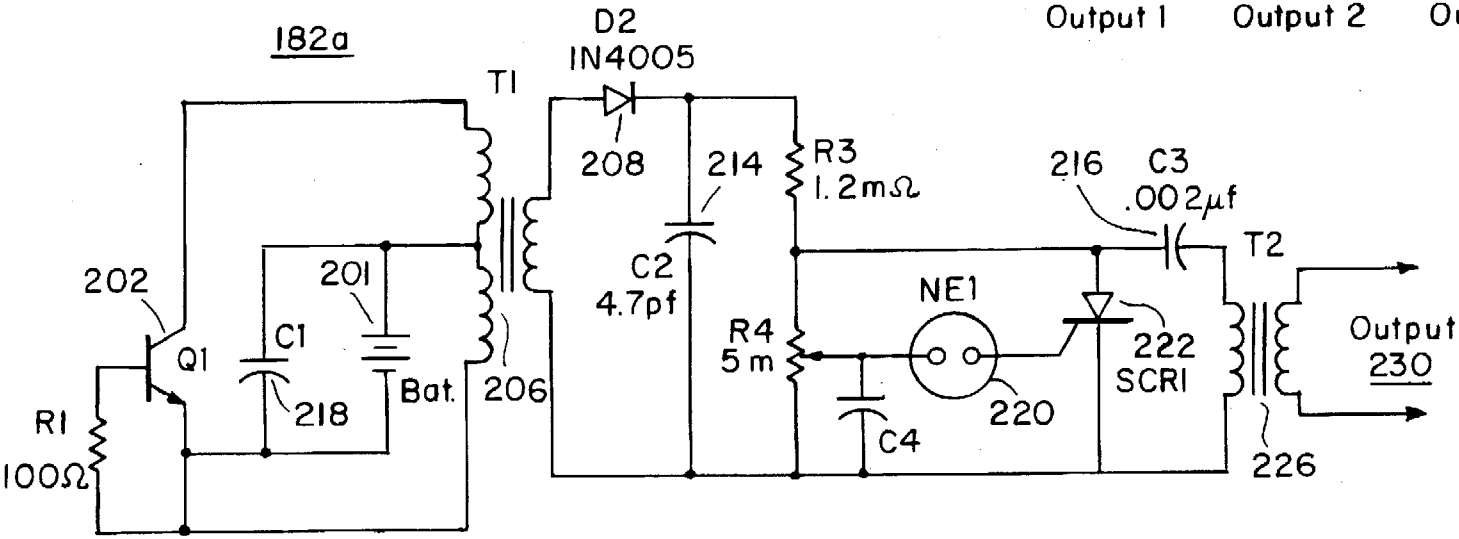
FIG. 16 is a circuit diagram of one embodiment of the sting circuit shown in FIG. 15.

The operation of the non-tunable circuit **182*a*, FIG. 16, is as follows. During deployment, on/off switch 200 is automatically closed by arming circuit 128, FIG. 15 and power from battery 201 is applied to the circuit. Transistor 202 together with transformer 206 form a self-oscillating DC-DC converter. The output of the converter is a transformer which produces a 400V AC signal across the diode 208. The output diode 208 is a half wave rectifier that converts the waveform back to a DC waveform of 200V peak. As the electrical voltage rises across SCR 222, neon gas source 220 ionizes causing SCR 222 to turn on thereby discharging the voltage across transformer 226 which produces a 2000V charge at the output 230**.

Figure 17:
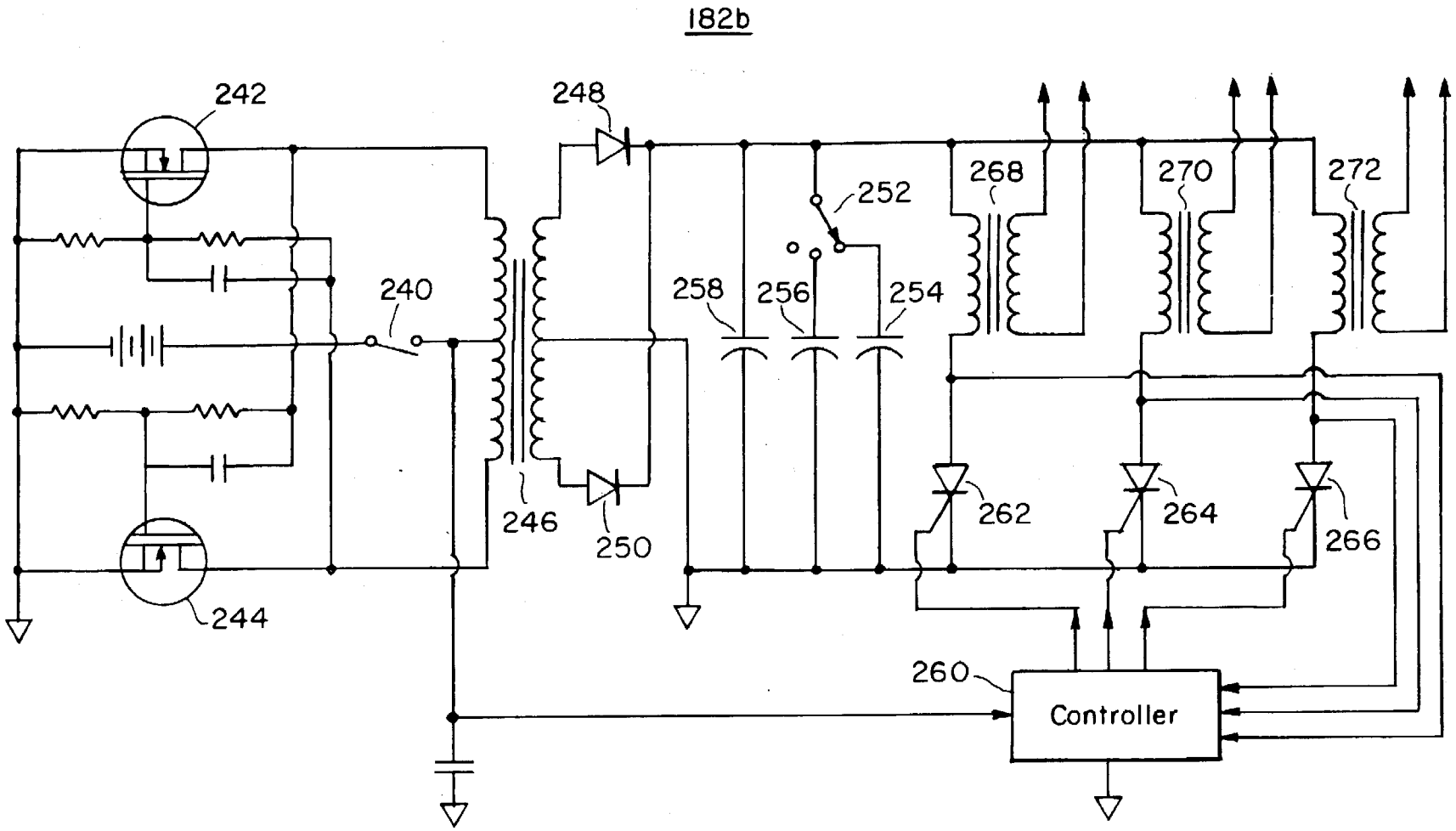
FIG. 17 is a circuit diagram of another embodiment of the sting circuit shown in FIG. 15.

Tunable sting circuit **182*b*, FIG. 17, produces extremely high voltages from 2 kV to 100,000 kV, at repetition rates between 1 and 20 pulses per second. The high voltage output pulse of circuit 182*b* is tunable prior to deployment to deliver different voltages to a perpetrator based on the circumstances. Circuit 182*b*** provides a shock for 5 to 15 seconds, then turns off for 1 to 3 minutes before shocking again. This cycle will continue for up to 30 minutes or until the batteries die. A set of metal electrodes are incorporated into the net to apply the shock to the body.

During deployment, on/off switch 240 is automatically closed by arming circuit 128, FIG. 17 to supply battery power to transistors 242 and 244 which, together with transformer 246, form a self-oscillating DC-DC converter. The output of the converter is a step-up transformer which produces a 2000V AC signal across the secondary winding of transformer 246. Diodes 248 and 250 form a full-wave rectifier that converts the waveform back to a DC waveform of 1000V. The transformer is sized to limit the current available at its output. The amount of energy available for each high voltage pulse is determined by the value of storage capacitance. Switch 252 permits capacitators 254 and 256 to be connected in parallel with capacitor 258 thereby increasing the duration of the output pulse. Periodically, microcontroller 260 triggers SCRs 262, 264 and 266, thereby completing a resonant circuit consisting of a capacitor 258 and the inductance of the primary winding of the step-up transformers 268, 270 and 272, etc. The output voltage is a decaying oscillation of peak magnitude of 2 to 100,000 kV with an oscillation frequency and pulse duration determined by the chosen position of switch 252. The user will have the option to disable the sting circuit prior to firing should the situation not warrant its use.

Figure 18:
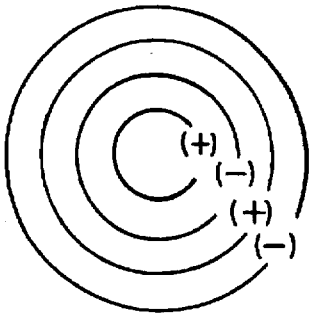
FIGS. 18–23 are schematic views of the various net wiring configurations for the sting circuits shown in FIGS. 16 and 17.
Figure 21:
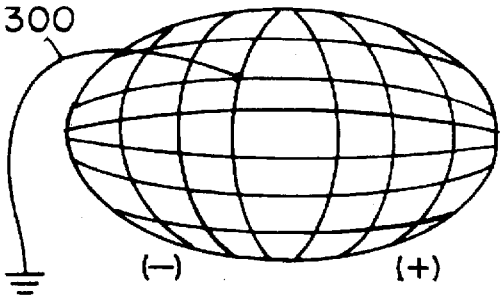
Figure 19:
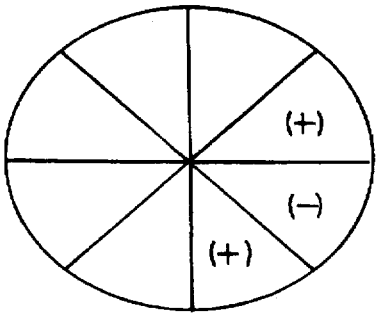
Figure 20:
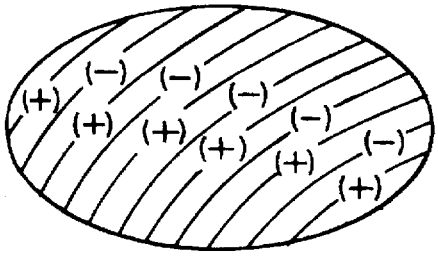
Figure 22:
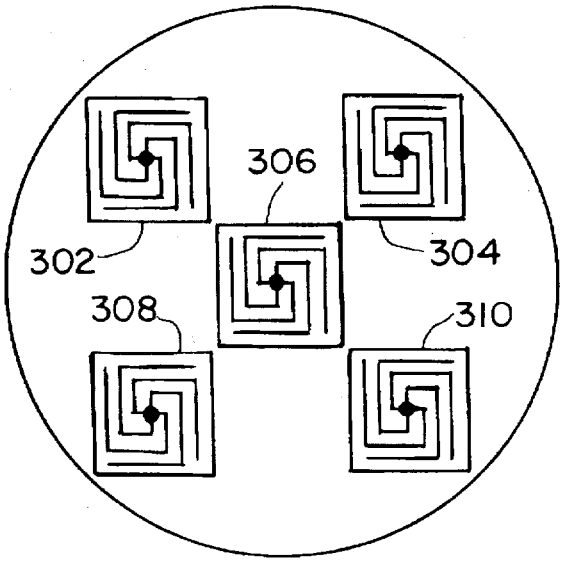
Figure 23:
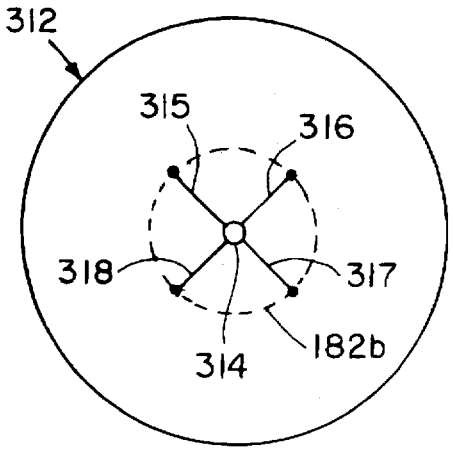

The output from sting circuits 182, 184, and 186, FIG. 15, may be arranged in net 32, FIG. 13, as wires forming alternating concentric rings as shown in FIG. 18, as alternating pie slices as shown in FIG. 19, or as alternating lines as shown in FIG. 20. In one embodiment, net 32, FIG. 13, may be used as a blockade in the form of an electric fence, FIG. 21, with additional grounding wire 300. Another design includes 9 ft. square circuits 302, 306, 308, 310, FIG. 22 and, each with four spirals spaced 4 inches apart. Still another design includes an 11' diameter net 312, FIG. 23 with electronic circuit **182*b*(FIG. 17) potted in elastomer package 314 at the apex of net 312. Leads 315, 316, 317 and 318** extend as shown.

Net Packaging Techniques

Figure 24:
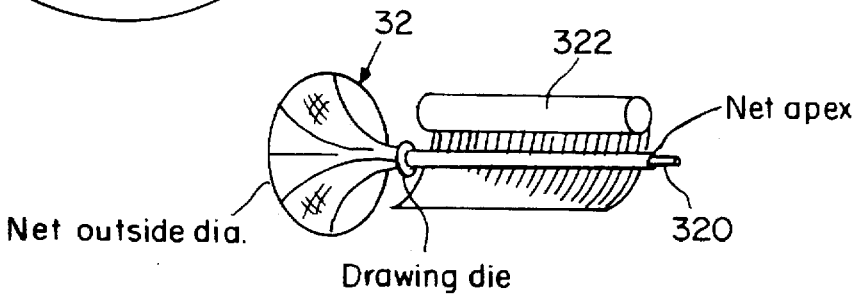
FIGS. 24–25 are schematic views of the zigzag folding method of packaging a restraining net within a projectile in accordance with this invention.
Figure 25:
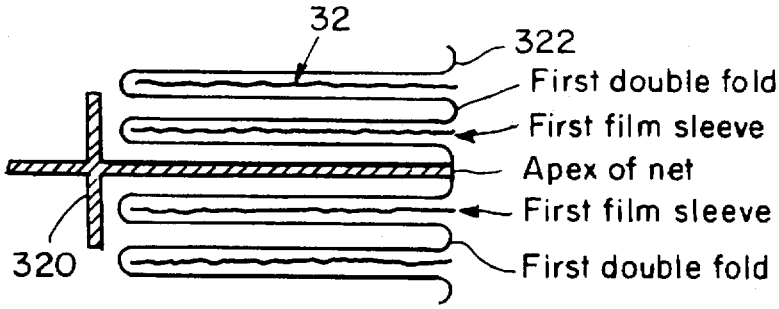

In order to minimize weight and residual debris on net deployment, the net is tightly packaged within net housing **56*b*, FIG. 9C of projectile 20*b*, FIG. 9A. To accomplish this, a zig-zag fold packing scheme is used. In this packing scheme, the net is wrapped around a central core 320, FIG. 24, by starting at the center of the net and folding the net back and forth on itself. Each fold, FIG. 25, of net is isolated from the others by a film sheath 322** which is wrapped around each layer. When the net is completely packed, the final layer of film sheath forms an outside skin for the net. The structural integrity of the projectile comes from the central core reinforced by the tightly wrapped net.

This packing scheme eliminates a structural outer skin which would have to be discarded at net deployment, and prevents the net from fouling on deployment due to tangled layers. On deployment, perimeter weights pull the net to a full open position tearing away the film sheath. The net separates from the core and flies forward capturing the target.

Figure 26A:
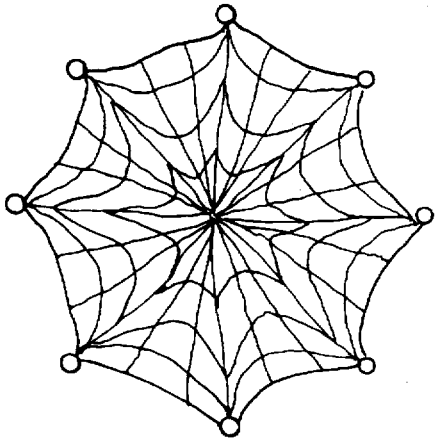
FIGS. 26A and 26B are schematic views of another method of packaging the restraining net within a projectile in accordance with this invention.
Figure 26B:
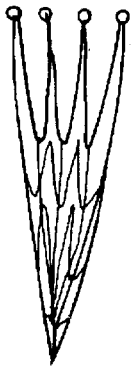

In another packaging scheme, FIG. 26A, the net perimeter is pinched between the perimeter weights towards the centroid of the net, FIG. 26B. The perimeter weights are then gathered and the net is packaged in a longitudinal fashion layering the net as it is packaged into the munition casing. This tendril packaging scheme results in a higher ballistic mass and minimal radial aerodynamic drag during the initial stages of deployment. This then permits lighter deployment charges and lower perimeter weight mass. When the perimeter weights have reached roughly two-thirds of their radial trajectory, the remainder of the net is pulled into the full open geometry.

Net Options

In another embodiment, a film is used as the capture medium rather than a net. Alternatively, films may be incorporated into a net for the purposes of aiding deployment, sustaining opened flight, and for the purpose of reducing the visibility of the target, aiding in confusion (thereby enhancing entanglement and increasing escape times).

The film is constructed of light weight, thin (<0.001 in.) polymer materials, optionally coated with reflective aluminum powder. The film is attached in layers on the leading edge in a series of concentric rings forming air passage which minimize aerodynamic drag. The films are also independent of the mesh therefore acting as a secondary barrier against escape. This independent construction where the film is on the outside prevents self entanglement of the law enforcement officer.

Any number of markers foams, gaseous, liquid or power based markets, irritants or incapacitants can be incorporated into the net such as chloroacetophenone (CN), orthochlorobenzal-malononitrile (CS), oleoresin capsicum (OC), or their blends. Also a variety of UV or visual markers and dyes can be used. Sticky foam or other structural adhesives can be applied and in application, the net is encased in a polymer sock and sealed around the spreader gun. The net is stored in the adhesive. During deployment, the spreader gun ruptures the sock and spreads the net which is coated with the adhesive, irritant, or marker. High vapor pressures in the hermetically sealed sock maintain the viscous nature of the net coatings such that shelf life is greatly enhanced. In those embodiments which require vaporization the large surface area of the net and rapid expansion volatizes the carrier compounds. The direct contact with the target concentrates the effect and therefore permits minimal use of the irritants, and limits unwanted migration and collateral damage.

Accordingly, the invention features a projectile which delivers a restraining net, a film, or a combination restraining net and film package proximate a perpetrator. If the triggering fuze incorporated into the net is an impact detector, FIGS. 5 and 6, the projectile is typically a tethered two piece design, FIGS. 4, 7, and 8. In the one piece projectile design, FIG. 9A, the fuze is typically an infrared proximity detector, FIG. 10; a manually set time delay fuze, FIG. 11; or an automatically set time delay fuze, FIG. 12. The net can be incorporated with one or more sting circuits, FIGS. 15–23. The net is tightly packaged for flight using a variety of net packaging techniques FIGS. 24–26B and preferably is connected to perimeter weights which form an integral part of the projectile, FIG. 9C. The net or film may incorporate chemical irritants, marking compounds, and/or an adhesive in addition to the sting circuits.

Therefore, although specific features of the invention are shown in some drawings and not others, this is for convenience only as some feature may be combined with any or all of the other features in accordance with the invention. And, other embodiments will occur to those skilled in the art and are within the following claims:

What is claimed is:

1. A ballistically deployed restraining net system comprising:

a projectile for being fired from a hand held launcher, said projectile including:

a packaged restraining net, net deployment means for unfurling the net in flight, means for triggering said net deployment means upon the occurrence of a preestablished criteria after the launch of said projectile from the hand held launcher, a power source, an open electrical circuit attached to said net and connected to said power source for disabling a target captured in said net, and means for starting the operation of the power source after the net is unfurled.

2. The system of claim 1 in which said means for triggering includes an impact detector and said preestablished criteria is the impact of said projectile with an object.

3. The system of claim 2 in which said impact detector includes a weight housed in a mechanical switch, said weight slidable within said switch to close said switch upon impact.

4. The system of claim 1 in which said means for triggering includes a timer and said criteria is the expiration of a preestablished time period.

5. The system of claim 1 in which said means for triggering includes a programmable timer and said event is the expiration of a programmed time period, said system further including a range detector and means, responsive to said programmable timer, for programming said timer to operate said means for triggering after a predetermined time, said predetermined time being a function of the range to an object and the rate of a flight of the projectile to the object.

6. The system of claim 1 in which said means for triggering includes a proximity detector and said criteria is reaching a predetermined distance from the projectile to an object.

7. The system of claim 6 in which said proximity detector includes an infrared sensor.

8. The system of claim 1 in which projectile includes two portions, a net projectile portion and a fuze projectile portion, said net and said deployment means housed in said net projectile portion, said means for triggering housed in said fuze projectile portion.

9. The system of claim 8 further including means for separating said fuze projectile portion from said net projectile portion in flight.

10. The system of claim 9 in which said means for separating includes a gas chamber in said net projectile portion, said chamber in communication on one end thereof with said fuze projectile portion.

11. The system of claim 10 further including means for pressurizing said gas chamber with a gas.

12. The system of claim 11 in which said projectile includes a propellant chamber for launching said projectile and said means for pressuring said gas chamber includes a passage within said projectile connecting said gas chamber with said propellant chamber.

13. The system of claim 9 further including a tether extending between said fuze projectile portion and said net projectile portion for maintaining both said projectile portions in the same flight path.

14. The system of claim 13 in which said net projectile portion includes a nose cone and said tether is wrapped about said nose cone.

15. The system of claim 14 further including a triangular shaped hook and loop strip, one half of which is affixed to said nose cone, the other half of which is attached to said tether for preventing snap back of said tether upon separation of said fuze projectile portion from said net projectile portion.

16. The system of claim 1 in which said projectile includes a net chamber for housing said net therein.

17. The system of claim 16 in which said net chamber includes a casing divided into weight portions connected to said net.

18. The system of claim 17 in which said net deployment means includes means to separate said weight portions in flight.

19. The system of claim 18 in which said means for separating includes an explosive charge placed in said net chamber and responsive to said fuze.

20. The system of claim 16 in which said net is packaged in said net chamber with an apex of the net at an open end of said chamber with folds of the net within said chamber.

21. The system of claim 16 in which said net chamber is hollow and said net is packaged therein with the net apex proximate one end of said net chamber and a plurality of tendrils of the net extending therefrom.

22. The system of claim 1 in which said net includes a disabling adhesive.

23. The system of claim 1 in which said net includes a disabling chemical.

24. The system of claim 1 in which said net includes a marking substance.

* * * * *

UNITED STATES PATENT AND TRADEMARK OFFICE

CERTIFICATE OF CORRECTION

PATENT NO. : 5,750,918
DATED : May 12, 1998
INVENTOR(S) : Mangolds et al.

It is certified that error appears in the above-identified patent and that said Letters Patent is hereby corrected as shown below:

Column 1,
Line 10, insert the following:

-- GOVERNMENT INTEREST
This invention was made with Government support under Contract No. DAAHB1-91-C-R231 awarded by the U.S. Army. The Government has certain rights in the invention. --

Signed and Sealed this

Twenty-third Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,750,918
DATED : May 12, 1998
INVENTOR(S) : Mangolds et al.

It is certified that error appears in the above-identified patent and that said Letters Patent is hereby corrected as shown below:

Column 1,
Line 10, insert the following:

-- GOVERNMENT INTEREST
This invention was made with Government support under Contract No. DAAH01-91-C-R231 awarded by the U.S. Army. The Government has certain rights in the invention. --

This certificate supersedes Certificate of Correction issued April 23, 2002.

Signed and Sealed this

Twenty-seventh Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,750,918
DATED : May 12, 1998
INVENTOR(S) : Mangolds et al.

It is certified that error appears in the above-identified patent and that said Letters Patent is hereby corrected as shown below:

Column 1,
Line 10, insert the following:

-- GOVERNMENT INTEREST
This invention was made with Government support under Contract No. DAAH01-91-C-R231 and Contract No. DAAE30-95-C-0061, both awarded by the U.S. Army. The Government has certain rights in the invention --

This certificate supersedes Certificate of Correction issued August 27, 2002.

Signed and Sealed this

Twenty-eighth Day of September, 2004

JON W. DUDAS
*Director of the United States Patent and Trademark Office*